US007287666B2

(12) United States Patent
De Laforcade

(10) Patent No.: US 7,287,666 B2
(45) Date of Patent: Oct. 30, 2007

(54) DEVICE FOR PACKAGING AND DISPENSING STACKED ITEMS, IN PARTICULAR COSMETICS ON A MEDIUM

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/992,657

(22) Filed: Nov. 22, 2004

(65) Prior Publication Data

US 2005/0133524 A1 Jun. 23, 2005

Related U.S. Application Data

(60) Provisional application No. 60/528,471, filed on Dec. 11, 2003.

(30) Foreign Application Priority Data

Nov. 24, 2003 (FR) ..... 03 13753

(51) Int. Cl.

| | |
|---|---|
| ***B65D 83/00*** | (2006.01) |
| ***B65G 59/00*** | (2006.01) |
| ***B65H 3/02*** | (2006.01) |
| ***G07F 11/16*** | (2006.01) |

(52) U.S. Cl. ..... 221/65; 221/259; 221/246; 221/210; 221/232; 206/38; 206/39.4

(58) Field of Classification Search ..... 22/65; 221/259, 269, 246, 210, 232, 65; 206/38, 206/39.4

See application file for complete search history.

(56) References Cited

U.S. PATENT DOCUMENTS

| | | | | |
|---|---|---|---|---|
| 933,663 | A * | 9/1909 | Pollock | 221/41 |
| 1,666,095 | A | 4/1928 | Jackson | |
| 2,299,940 | A * | 10/1942 | Thomasma | 221/26 |
| 2,360,162 | A | 10/1944 | Reenstierna | |
| 2,591,855 | A * | 4/1952 | Nicholson | 221/232 |
| 2,973,882 | A | 3/1961 | Jeffus | |
| 3,269,591 | A * | 8/1966 | Harter | 221/23 |
| 3,421,658 | A * | 1/1969 | Cooksey | 221/307 |
| 3,517,855 | A * | 6/1970 | Hillis | 221/259 |

(Continued)

FOREIGN PATENT DOCUMENTS

| | | |
|---|---|---|
| DE | 23 65 498 | 3/1975 |

(Continued)

*Primary Examiner*—Gene O. Crawford
*Assistant Examiner*—Rakesh Kumar
(74) *Attorney, Agent, or Firm*—Oliff & Berridge, PLC

(57) ABSTRACT

A device for packaging and dispensing stacked items may include, a box including:

a first portion, in particular a cover; and a second portion, in particular a drawer, that is movable relative to the first portion between a retracted position and an extended position; and a stack of items disposed in the second portion;

the first portion including a drive member configured to press against the stack of items while the second portion is being moved toward the retracted position, and to entrain an item in contact therewith relative to a remainder of the stack in order to enable the item to be grasped by a user; and the second portion and the drive member also being configured in such a manner as to prevent the drive member from pressing against the stack of items over at least a fraction of the stroke of the second portion from the retracted position toward the extended position.

34 Claims, 3 Drawing Sheets

U.S. PATENT DOCUMENTS

| | | | | |
|---|---|---|---|---|
| 3,563,412 | A * | 2/1971 | James | 221/224 |
| 3,899,104 | A * | 8/1975 | Kohner | 221/197 |
| 4,071,165 | A * | 1/1978 | Leopoldi | 221/259 |
| 4,241,529 | A * | 12/1980 | Baur | 40/513 |
| 4,777,693 | A * | 10/1988 | Diba et al. | 15/236.01 |
| 4,784,556 | A * | 11/1988 | Ackeret | 414/788.8 |
| 4,902,193 | A * | 2/1990 | Ackeret | 414/788.8 |
| 4,942,591 | A * | 7/1990 | Nease et al. | 375/330 |
| 5,104,000 | A * | 4/1992 | Goff | 221/191 |
| D371,723 | S * | 7/1996 | Hirao | D7/602 |
| 6,082,581 | A * | 7/2000 | Anderson et al. | 221/232 |
| 6,176,389 | B1 * | 1/2001 | de Laforcade | 220/695 |
| 6,230,879 | B1 | 5/2001 | Lin | |
| 6,578,732 | B1 | 6/2003 | Mahry | |
| 6,612,763 | B1 * | 9/2003 | Yoshihara | 400/692 |
| 6,832,697 | B2 * | 12/2004 | Lai | 221/210 |
| 2002/0162849 | A1 * | 11/2002 | Chen | 221/65 |
| 2003/0106900 | A1 * | 6/2003 | Storz | 221/259 |
| 2003/0121932 | A1 * | 7/2003 | Wajda | 221/259 |

FOREIGN PATENT DOCUMENTS

| | | |
|---|---|---|
| EP | 0 319 046 A2 | 6/1989 |
| FR | 461 025 | 10/1968 |
| FR | 2 654 081 | 5/1991 |
| FR | 2 709 475 | 3/1995 |
| GB | 2 118 146 A | 10/1983 |
| GB | 2 358 627 A | 8/2001 |

* cited by examiner

DEVICE FOR PACKAGING AND DISPENSING STACKED ITEMS, IN PARTICULAR COSMETICS ON A MEDIUM

This non provisional application claims the benefit of French Application No. 03 13753 filed on Nov. 24, 2003 and U.S. Provisional Application No. 60/528,471 filed on Dec. 11, 2003.

The present invention relates to a device for packaging and dispensing stacked items, in particular cosmetics on a medium.

BACKGROUND OF THE INVENTION

Certain active substances for use in cosmetics, including in care products, can be presented to the user in the form of thin sheets, e.g. for being impregnated with a liquid or dissolved in a liquid.

Packaging such sheets in a conventional box with a cover that can be raised or removed, is not very satisfactory.

The sheets are very light in weight and run the risk of escaping from the box when the cover is opened.

There is also a risk that a user seeking to take hold of a sheet in the box will also touch other sheets, which can give rise to problems of hygiene.

It can also be difficult to take hold of only one sheet at a time.

U.S. Pat. No. 2,360,162 describes a dispenser of chewing gum sticks, the dispenser including a feed plate enabling sticks to be extracted one by one. The stack of sticks rests continuously on the plate, and a spring is provided on a cover to push the stack down against the plate.

U.S. Pat. No. 2,973,882 describes another chewing gum stick dispenser including a slider enabling the top stick on a stack to be pushed through a slot.

U.S. Pat. Nos. 1,666,095, 6,230,879, and 6,578,732, British patent application GB 2 358 627, and Swiss patent CH 461 025 describe dispensers that are fairly similar.

European patent application EP 0 319 046 describes a business card dispenser that operates in similar manner.

Those known dispensers are not adapted to thin sheets, and they are also relatively complex.

US application 2003/0106900 describes a dispenser of sheets of a product, comprising a top part movable relative to a bottom part containing stacked sheets. The top part comprises a deformable portion on which the user may press during the movement of the top part, to entrain a sheet toward the exit.

The deformable portion may come in contact with the stack of sheets whichever is the position of the top part relative to the bottom part.

OBJECTS AND SUMMARY OF THE INVENTION

The present invention seeks to remedy some or all of the above-identified drawbacks by proposing a device for packaging and dispensing stacked items, which device comprises:

- a box comprising:
  - a first portion, in particular a cover; and
  - a second portion, in particular a drawer, that is movable relative to the first portion of the box between a retracted position and an extended position; and
- a stack of said items disposed in the second portion of the box.

The first, portion of the box, in particular the cover of the box, includes a drive member configured firstly to press against the stack of items when the second portion of the box, in particular the drawer, is moved towards the retracted position, and secondly to drive an item in contact therewith relative to the remainder of the stack in order to enable the item to be grasped by the user.

The second, portion of the box, in particular the drawer, and the drive member are also configured in such a manner as to prevent the drive member from pressing on the stack of items over at least a fraction of the stroke of the second portion of the box from the retracted position towards the extended position.

Such a device enables the items to be dispensed one by one, by using a simple action that is applied to the second portion of the box and that consists in causing it to perform one go-and-return movement relative to the first portion of the box on each dispensing cycle.

During the beginning of the dispensing cycle, e.g. while the drawer is being extracted from the cover, no item is dispensed. Dispensing takes place during the return movement of the drawer.

The invention also makes it possible to avoid unwanted delivery of items prior to use and guarantees that they are packaged hygienically.

Such a device can also be manufactured at relatively low cost, compatible with large-scale distribution, in particular by making the second portion of the box in the form of two hinged portions connected together by a film hinge, by molding a plastic material, as described in greater detail below.

The drive member may comprise an elastically deformable tab configured in such a manner as to enable the drive member to exert sufficient contact pressure on the stack of items to entrain the item on the top of the stack.

The tab may be made integrally with the first portion by molding a plastic material.

Thus, in an embodiment of the invention, by way of example, the device may be deprived of any deformable portion on its upper side, on which the user would have to press to entrain an item toward the extended position.

The second, portion of the box in particular the drawer, may include a slot through which the drive member extends while it is in contact with the stack.

The second portion of the box may include at least one slideway configured to move the drive member away from the stack of items, at least during a fraction of the stroke of the second portion of the box from the retracted position towards the extended position.

The second portion of the box and the drive member may be arranged in such a manner that the drive member engages or begins to engage in the slideway when said second portion of the box has reached a fully retracted position. Thus, in this full retracted position, the drive member may no longer be in contact with the stack of items.

In a particular embodiment, the second portion of the box thus has two slideways associated respectively with two opposite sides of the second portion.

The drive member may include projections configured in such a manner that, at the beginning of a new dispensing cycle, it rests on the slideways during at least a fraction of the stroke of the second portion of the box from the retracted position towards the extended position, in particular it may include projections made integrally with the drive member by molding a plastics material.

By way of example, the second portion of the box may be made with a frame having opposite branches each carrying one of said slideways.

The second portion of the box may include at least one slideway having an end portion with which the drive member comes into contact while the second portion of the box is being moved from the extended position to the retracted position in order to dispense an item. The second portion of the box may have a wall that is arranged to force the drive member to go past the second end of the slideway when the second portion is brought into the fully closed position, so that the drive member then rests on the slideway when the second portion of the box is again moved towards its extended position, during the following dispensing cycle.

To make this possible, the shortest distance between a slideway and said wall may be less than the distance between a surface of the drive member which comes to bear against said wall and a surface of the drive member which comes to bear against the slideway when the drive member is resting thereon without making contact with the stack of items.

The front end portions of the slideways may taper forwardly, thereby making it easier for the drive member to go past them.

The front end portions of the slideways may also be free, thereby making it easier for the drive member to go past them.

The second portion of the box may include a ramp, which may be constituted in particular by the above-mentioned wall, with the drive member coming to bear against it when the second portion of the box has been moved from the extended position towards the retracted position in order to dispense an item, and the second portion of the box is close to the retracted position.

With a downward rim, the ramp may define a setback enabling the second portion to be grasped by a user in order to entrain it between its retracted and extended positions.

The second portion of the box may be made as two hinged portions connected together by a hinge, in particular a film hinge.

The second portion of the box may be made with another ramp, at the rear, arranged to skew the stack of items in forward slope when one of the hinged portions is folded down onto the other, prior to the first and second portions being assembled together.

The first portion of the box, in particular the cover, may be arranged to enable the two above-mentioned hinged portions to form a forwardly-open angle when the second portion is in the extended position. Such an angle may make it easier for an item being dispensed to pass through.

The second portion of the box may include a projection on its top front edge suitable for forcing the two hinged portions to rest against each other when the second portion of the box is in the retracted position.

The second portion of the box may be made with a bottom wall that presents a bottom face having a first shape in relief co-operating with a corresponding second shape in relief of the first portion of the box, to define an end-of-stroke abutment for the second portion when it is in the extended position.

In another aspect, the invention also provides a method of manufacturing a device for dispensing items, the method comprising the following steps:

placing a stack of items to be dispensed in a drawer comprising two hinged-together portions; and assembling the drawer with a cover;

the cover including a drive member configured to press against the stack of items while the drawer is being moved towards its retracted position, and to entrain an item in contact therewith relative to the remainder of the stack in order to enable it to be grasped by the user;

the drawer and the drive member also being configured in such a manner as to prevent the drive member from pressing against the stack of items over at least a fraction of the stroke of the drawer from the retracted position towards the extended position.

In another aspect, the invention provides a method of dispensing items contained in a drawer that is movable relative to a cover, the items forming a stack in the drawer, the cover including a drive member configured to press against the stack of items while the drawer is being moved towards the retracted position and to entrain an item in contact therewith relative to the remainder of the stack in order to enable it to be grasped by the user, the drawer and the drive member also being configured in such a manner as to prevent the drive member from pressing against the stack of items over at least a fraction of the stroke of the drawer from the retracted position towards the extended position.

BRIEF DESCRIPTION OF THE DRAWINGS

The invention will be better understood on reading the following detailed description of a non-limiting embodiment thereof, and on examining the accompanying drawings, in which.

MORE DETAILED DESCRIPTION

Figure 1:
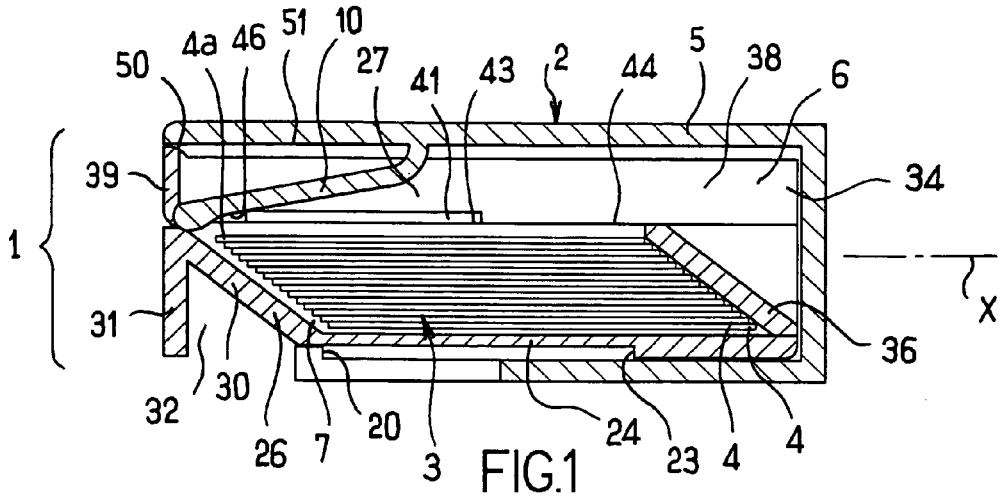
FIG. 1 is a diagrammatic longitudinal section on a mid-plane of a device made in accordance with the invention, the drawer being shown in the retracted position.

The packaging and dispenser device 1 shown in FIG. 1 comprises a box 2 housing a stack 3 of items 4.

The items may be generally flat and may be constituted, for example, by thin sheets that are flexible and that include at least one active agent, in particular an agent that is active in cosmetics or dermatology.

By way of example, the above-mentioned sheets may comprise a substrate of a dry gum of synthetic or plant origin, for example an agar gel.

Where appropriate, the sheets may be mesh sheets with at least one active agent contained in the mesh.

By way of example, the thickness of the sheets is less than 0.5 millimeters (mm), for example being 0.2 mm on average in the example described.

The items 4 may be of rectangular or square format, for example, with a long dimension that is less than or equal to 5 centimeters (cm) or 10 cm, these values being given solely by way of example.

The number of items 4 in the stack 3 lies, for example, in the range ten to one hundred.

By way of example, the items 4 may be for single use and may be arranged, for example, so as to dissolve in a liquid, in particular water, for the purpose of releasing at least one active agent.

Figure 19:
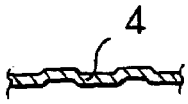

In a variant, and as shown in FIG. 19, the items 4 may include shapes in relief, for example projections.

Figure 20:
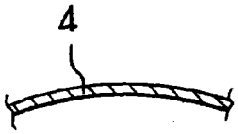
FIGS. 19 to 21 are fragmentary and diagrammatic cross-section views showing variants of items suitable for being dispensed.

FIG. 20 shows an item of a shape that is generally concave.

Figure 21:
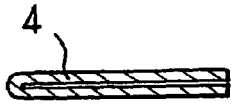

Each item 4 may be folded in half, as shown in FIG. 21.

Figure 2:
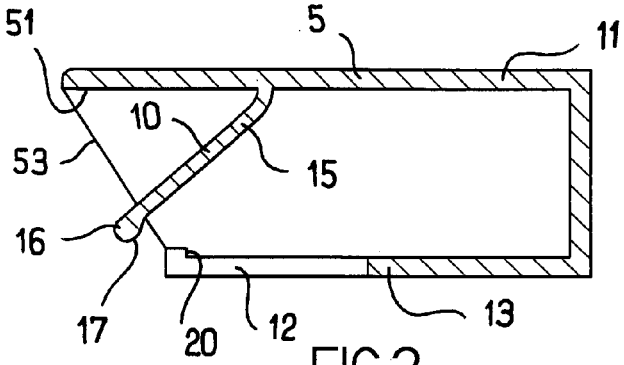
FIG. 2 shows the cover of the FIG. 1 box in isolation.

The box 2 comprises a first portion constituted by a cover 5, shown in isolation in FIG. 2, and a second portion formed by a drawer 6 having a bottom wall 24 which defines the bottom of a housing 7 in which the stack 3 is placed.

The term "cover" should be understood broadly and covers equally well a portion of the box which is on the outside as in the example shown, as a portion of the box which is itself covered by a covering or a body of the box.

The cover 5 may thus constitute the body of the box, extending all around the drawer 6 except in front, as shown in the drawings.

The cover 5 could constitute no more than the top portion of the box, for example, it could cover only the top of the drawer, in full or in part, with this configuration not being shown in the drawings.

The drawer 6 can be moved relative to the cover 5 along an axis X, and in the example described, it can be moved in translation.

Figure 12:
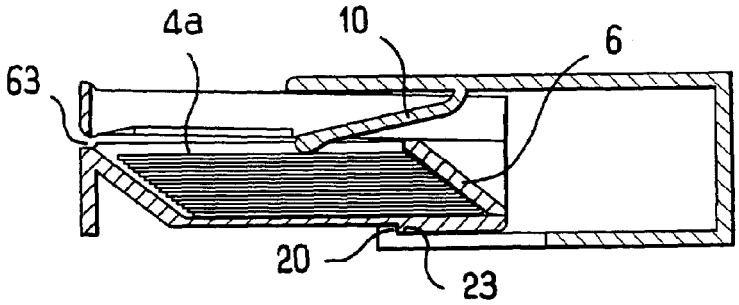

In FIG. 1, the drawer 6 is shown in its retracted position and it can be moved forwards, i.e. to the right in FIG. 1, in order to reach an extended position as shown in FIG. 12, in particular.

In the example shown, the axis X also corresponds to the longitudinal axis of the device.

The outside shape of the cover 5 may be generally that of a rectangular parallelepiped, with an opening at its front end occupying a plane 53 that slopes downwards and rearwards.

The cover 5 of the box includes a drive member 10 which, in the example described, is made integrally with the top wall 11 of the cover 5 by molding a plastics material, the cover 5 itself advantageously constituting a single part.

An opening 12 may be made in the bottom wall 13 of the cover 5 in order to enable the drive member 10 to be molded by using a mold with a slide.

In the example described, the drive member 10 comprises a flexible tab 15 which extends obliquely downwards and forwards, as can be seen in FIG. 2, with its bottom end connected to a terminal portion 16 for coming into contact with the item 4*a* that is present on the top of the stack 3 during a dispensing cycle as described below.

In the example shown, the terminal portion 16 presents a fraction 17 of its outside surface that is substantially circularly cylindrical about an axis Y, which axis is substantially perpendicular to the axis X and parallel to the top face of the stack 3.

Figure 4:
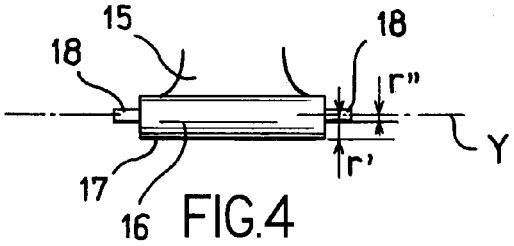
FIG. 4 is a diagram showing a portion of the drive member in front view.

As can be seen in FIG. 4, at its lateral ends, the terminal portion 16 is provided with projections 18, e.g. circularly cylindrical projections about the axis Y, and of radius r" that is less than the radius r' of the fraction 17.

The tab 15 may be made of a plastic material that enables it to bend elastically forwards and upwards, in particular during a cycle for dispensing an item 4, for example it can be made of a polyolefin, a polyamide, e.g. Nylon®, Debrin®, or a styrene polymer.

As can be seen in FIG. 2, the cover 5 can be made with a first shape in relief 20 close to the front end of the bottom wall 13, formed by an upward step in the example shown, which is designed to co-operate with a second shape in relief 23 of the drawer 6, this second shape in relief 23 likewise being constituted in the example described by a step, made in the bottom face of the bottom wall 24.

Figure 3:
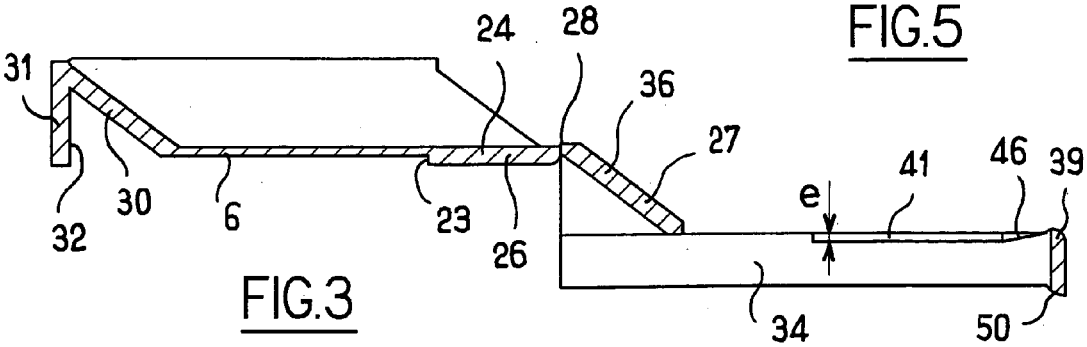
FIG. 3 shows the drawer in isolation in the deployed configuration.

In the example described, the drawer 6 comprises two hinged portions, a first portion 26 and a second portion 27 interconnected by a film hinge 28 which makes it possible, in particular, for the drawer 6 to be made by molding a plastics material in a deployed configuration, such as the configuration shown in FIG. 3, for example. In a variant that is not shown, the two portions of the drawer 26 and 27 are connected together by a hinge other than a film hinge, e.g. a hinge having a metal hinge pin.

The first portion of the drawer 26 which includes the bottom wall 24, presents a front wall that slopes upwards and forwards, defining a ramp 30 that is extended at the front by a downwardly-directed rim 31.

A setback 32 is formed behind the rim 31, under the ramp 30, and enables the user to engage at least part of a finger, e.g. the index finger, therein in order to move the drawer 6 relative to the cover 5 towards its extended position.

The slope of the ramp 30 in the example shown is about 45° relative to the bottom wall 24, however some other slope could be used, for example lying in the range 30° to 60°, and the slope could optionally be a varying slope.

Figure 5:
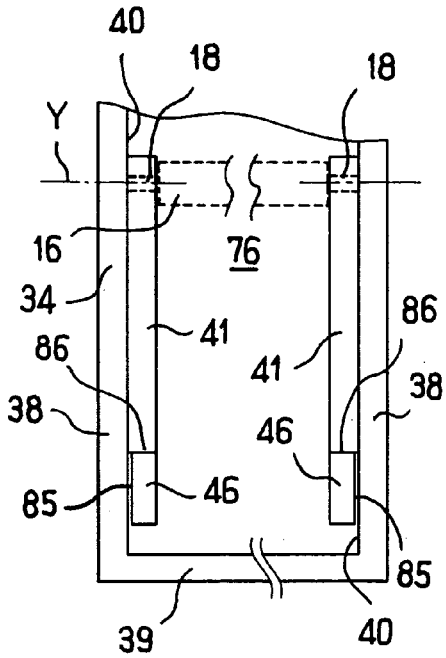
FIG. 5 is a diagrammatic and fragmentary plan view showing the frame of the drawer.

The second portion 27 of the drawer 6 comprises a frame 34 which can be seen in FIG. 5, and a rear wall 36 which extends, when the drawer 6 is in place inside the cover 5, rearwards and downwards, at an angle of inclination relative to the bottom wall 24 which is, for example, substantially the same as the angle of inclination of the ramp 30.

As shown, the frame 34 may be substantially rectangular in shape, having two lateral branches 38 extending generally parallel to the axis X and interconnected at the front by a front branch 39, which front branch extends substantially perpendicularly to the axis X and parallel to the top face of the stack 3.

The branches 38 and 39 define a slot 76 through which the drive member extends in order to press against the stack 3.

Each of the lateral branches 38 carries a slideway 41 on its face 40 facing the other lateral branch. In the example described, each slideway 41 presents a substantially plane bottom face 43 that is coplanar with the bottom face 44 of the corresponding lateral branch 38, as can be seen in FIG. 1, with each lateral branch 38 being, for example, of generally rectangular cross-section.

As can be seen in FIG. 3 in particular, each of the slideways 41 may also present a thickness e that is substantially constant over the major portion of its length, and at the front it may present a respective end portion 46 of thickness that tapers going forwards, the top face 70 of each of said end portions 46 extending in a plane that slopes rearwards and upwards, when the drawer 6 is in the utilization configuration shown in FIG. 1.

The front portion 46 of each slide slideway 41 may be free, as shown in FIG. 5, being separated from the corresponding branch 38 by a gap 85.

Thus, each front portion 46 is held to the remainder of the slideway 41 by a junction zone 36 only.

At its top edge, the front branch 39 has a projection 50 (as can be seen in FIG. 5) that presses against the bottom face 51 of the top wall 11 of the cover 5, when the drawer 6 is fully retracted.

Figure 17:
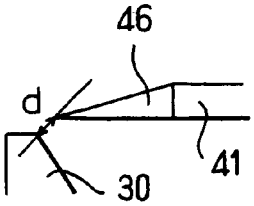
FIG. 17 shows an embodiment detail.

In the example under consideration, the shortest distance d between the end portion 46 and the ramp 30 is less than the difference between the radii r'−r", as can be seen in FIG. 17, in particular.

Figure 6:
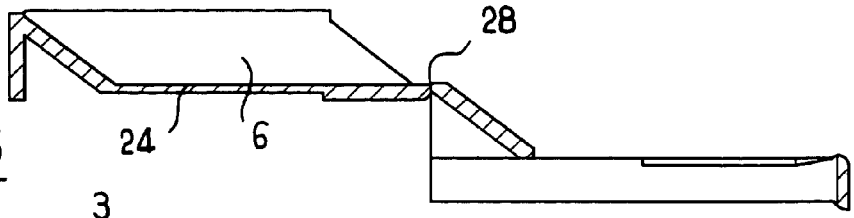
FIGS. 6 to 8 are diagrams showing different steps in manufacturing the device.
Figure 7:
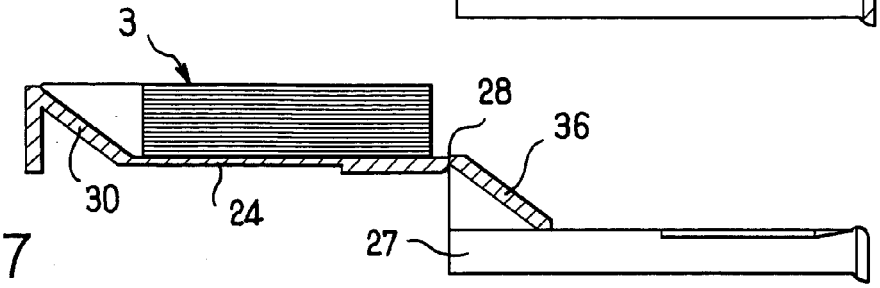

After the drawer 6 and the cover 5, have been made, the stack 3 of items to be dispensed is placed on the bottom wall 24, as shown in FIGS. 6 and 7, the drawer 6 being in its deployed configuration, and then the second portion 27 of the drawer is folded onto the first portion 26. Where appropriate, these operations can be performed by the user, in particular when the stack 3 is constituted by a refill.

Figure 8:
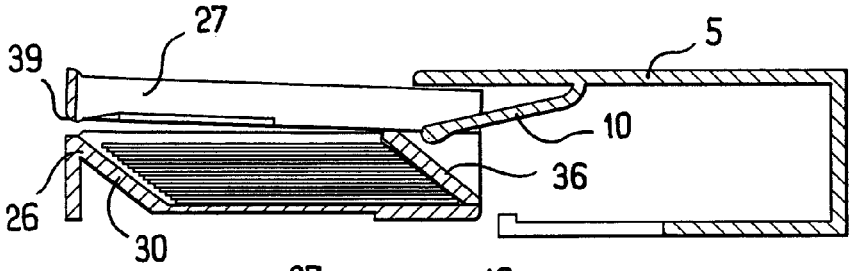

During the movement of the second portion of the drawer 27, the wall 36 skews the items 4 in the stack 3 into a slope so as to bring their front edges substantially against the ramp 30, as can be seen in FIG. 8.

In this figure, it can be seen that so long as the drawer 6 is not fully retracted in the cover 5, the front branch 39 is spaced a little apart from the front top edge of the first portion 26 of the drawer.

The drawer 6 may have its rear end inserted into the cover 5, the drive member 10 bending and sliding on the rear wall 36, while the drawer 6 is pushed into the cover 5.

Figure 9:
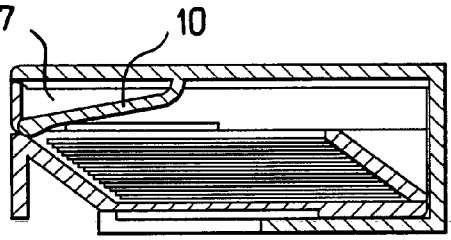
FIG. 9 to 16 are diagrams showing different steps in a cycle for dispensing an item.

Below, it is assumed that the drawer 6 is in the position shown in FIG. 9, i.e. that it is fully retracted inside the cover 5.

Figure 18:
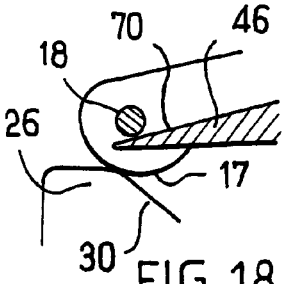
FIG. 18 shows a detail of the relative positioning of the drive member and the cover of the box in the configuration of FIG. 16.

The projections 18 then rest on the front end portions 46 of the slideways 41, as can be seen in FIG. 18.

Figure 10:
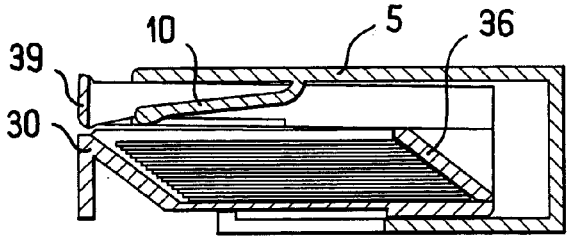

On beginning to extract the drawer 6, the projection 50 ceases to press against the top wall 11 of the cover 5, thereby enabling the top branch 39 to move a little away from the top end of the ramp 30, as shown in FIG. 10.

The projections 18 continue to rest on the slideways 41, thereby preventing the end portion 16 of the drive member 10 from pressing against the stack 3.

Figure 11:
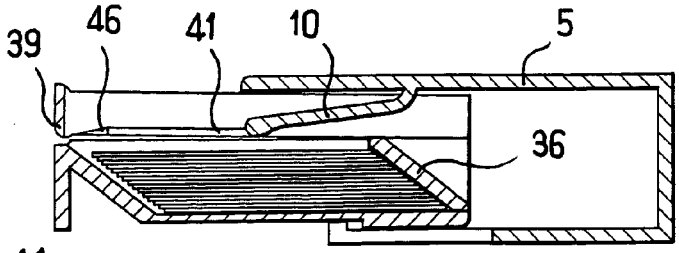

As the drawer 6 continues to be extracted, the projections 18 reach the rear ends of the slideways 41, as shown in FIG. 11, after which the drive member 10 leaves the slideways 41 and can press against the item 4*a* on the top of the stack 3, as shown in FIG. 12, given that the tab 15 is resilient.

Figure 13:
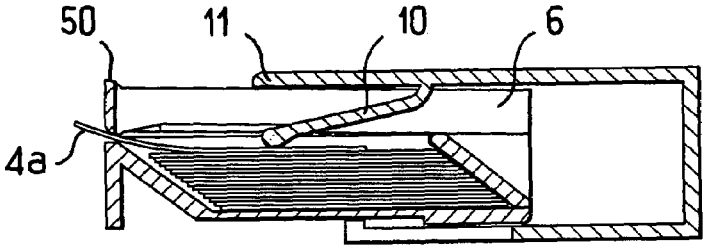
Figure 14:
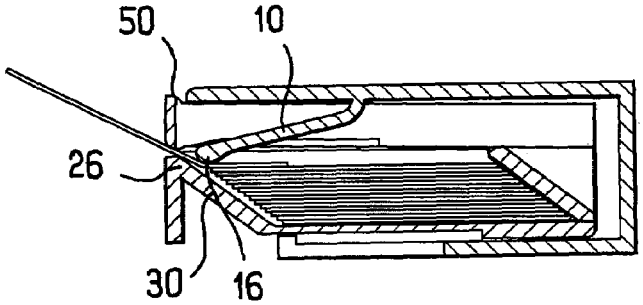

At this moment, the shapes in relief 20 and 23 come substantially into abutment, and the drawer 6 is substantially in its fully extended position. Thereafter, when the user begins to push the drawer back into the cover 5, the terminal portion 16 of the drive member causes the items 4*a* on the top stack 3 to slide forwards relative to the remainder of the stack, with this item 4*a* being capable of leaving through the gap 63 provided between the front branch 39 and the top end of the ramp 30, as can be seen in FIG. 13.

When the drawer 6 has almost reached its retracted position, the item 4*a* in the example described has been extracted from the device sufficiently for it to be easy for the user to grasp.

Figure 15:
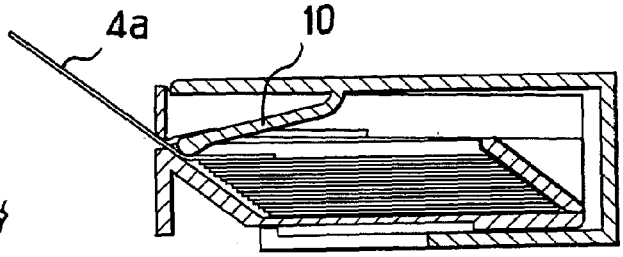

The projection 50 has still not reached the top wall 11 of the cover 5. When this occurs, as shown in FIG. 15, the terminal portion 16 has practically reached the top of the ramp 30.

Figure 16:
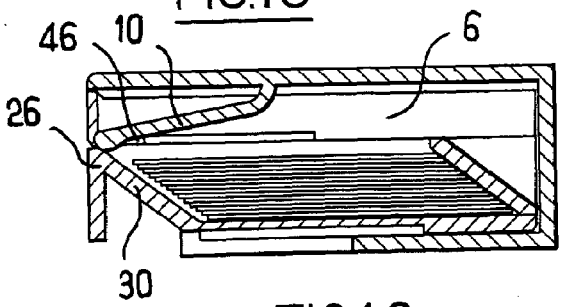

As the movement of returning the wall continues, the frame 34 tends to press against the first portion 26 of the drawer, as shown in FIG. 16, and the projections 18 deform elastically and go past the front end portions 46 of the slideways 41, with the assembly taking up the configuration shown in FIG. 18.

The front end portions 46 can bend upwards under drive from the projections 18 before they manage to get past them.

When the user pulls the drawer 6 for a new cycle of dispensing an item 4, the projections 18 rest on the slideways 41, thus making it possible to prevent the drive member from pressing against the stack 3, as mentioned above.

Naturally, the invention is not limited to the embodiment described above.

In particular, the drive member 10 may be made, for example, with a metal pin whose ends constitute the projections 18.

The terminal portion 16 may receive treatment, a coating, or an element, e.g. made of elastomer, in order to increase friction between itself and the underlying item 4.

The tab 15 could have some other shape, for example it could have be perforated.

The device 1 may optionally be arranged so as to be suitable for being refilled.

The cover 5 may optionally be made of a transparent plastics material.

Where appropriate, the drive member may be fitted to the remainder of the cover 5, for example it may be snap-fastened thereto.

Independently or in combination with the above, the present invention also provides a device for packaging and dispensing stacked items, the device comprising:

a box comprising:

a first portion, in particular a cover; and a second portion, in particular a drawer, that is movable relative to the first portion between a retracted position and an extended position; and a stack of said items disposed in the second portion of the box;

the first portion of the box including a drive member configured firstly to press on the stack of items while the second portion, in particular the drawer, is being moved towards the retracted position, and secondly to entrain an item in contact therewith relative to the remainder of the stack in order to enable it to be grasped by the user;

the second portion of the box and the drive member being configured in such a manner as to no longer put the drive member in contact with the stack of items when the second portion of the box is fully put in its retracted position.

Independently or in combination with the above, the present invention also provides a device for packaging and dispensing stacked items, the device comprising:

a box comprising:

a first portion, in particular a cover; and a second portion, in particular a drawer, that is movable relative to the first portion between a retracted position and an extended position; and a stack of said items placed in the second portion;

the first portion, in particular the cover of the box, includes a drive member configured firstly to press against the stack of items while the second portion, in particular the drawer, is being moved towards its retracted position, and secondly to entrain an item in contact therewith relative to the remainder of the stack in order to enable it to be grasped by the user;

the second portion of the box being in the form of two hinged portions connected together by a hinge.

Throughout the description, including in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for packaging and dispensing stacked items, the device comprising:

a box comprising:

a first portion; and a second portion that is movable relative to the first portion between a retracted position and an extended position and including at least one slideway; and a stack of said items disposed in the second portion of the box;

the first portion of the box including a drive member configured to press against the stack of items while the second portion of the box is being moved toward the retracted position, and to entrain an item in contact therewith relative to the remainder of the stack in order to enable the item to be grasped by a user; and the second portion of the box and the drive member also being configured in such a manner as to prevent the drive member from pressing against the stack of items over at least a fraction of the stroke of the second portion from retracted position toward the extended position, wherein the second portion of the box includes a slot through which the drive member extends while in contact with the stack, and said at least one slideway being configured to keep the drive member away from the stack of items during at least a fraction of the stroke of the second portion of the box going from the retracted position toward the extended position.

2. A device according to claim 1, wherein each item is flat.

3. A device according to claim 1, wherein each item is folded in half.

4. A device according to claim 1, wherein each item is concave.

5. A device according to claim 1, wherein each item includes shapes in relief.

6. A device according to claim 5, wherein said shapes in relief comprise projections.

7. A device according to claim 1, wherein the drive member comprises an elastically deformable tab configured to enable the drive member to exert contact pressure on the stack of items.

8. A device according to claim 7, wherein the tab is made integrally with the first portion of the box by molding a plastic material.

9. A device according to claim 1, wherein the second portion has two slideways associated with two respective opposite sides of the second portion.

10. A device according to claim 9, wherein the drive member includes projections configured in such a manner as to rest on the slideways during at least a fraction of the stroke of the second portion of the box from the retracted position towards the extended position.

11. A device according to claim 10, wherein said projections are made integrally with the drive member by molding a plastic material.

12. A device according to claim 9, wherein the second portion of the box is made with a frame having opposite branches each carrying one of the two slideways.

13. A device according to claim 10, wherein the second portion of the box is made with a frame having opposite branches each carrying one of the two slideways.

14. A device according to claim 1, wherein the second portion of the box includes at least one slideway having an end portion with which the drive member comes into contact while the second portion is being moved from the extended position to the retracted position in order to dispense an item, and wherein the second portion of the box includes a wall arranged to force the drive member to go past the end portion of the slideway when the second portion of the box is brought into the fully closed position, so that the drive member then rests on the slideway while the second portion of the box is again being moved toward the extended position.

15. A device according to claim 14, wherein a shortest distance between the slideway and said wall is less than a distance between a surface of the drive member that comes to press against said wall and a surface of the drive member that comes to press against the slideway when the drive member is resting thereon without making contact with the stack of items.

16. A device according to claim 14, wherein the end portion of each slideway tapers forwardly.

17. A device according to claim 15, wherein the end portion of each slideway tapers forwardly.

18. A device according to claim 14, wherein the end portion of each slideway is free.

19. A device according to claim 15, wherein the end portion of each slideway is free.

20. A device according to claim 1, wherein the second portion of the box includes a ramp against which the drive member comes to bear while the second portion of the box is being moved from the extended position toward the retracted position in order to dispense an item, and while the second portion is close to the retracted position.

21. A device according to claim 20, wherein the ramp co-operates with a downwardly directed rim to define a setback enabling the second portion of the box to be grasped by a user in order to move the second portion of the box between the retracted and extended positions.

22. A device according to claim 1, wherein the second portions of the box comprises two hinged-together portions connected together by a hinge.

23. A device according to claim 22, wherein the second portion of the box is made with a ramp arranged to skew the stack of items forward when one of the two hinged-together portions is folded onto the other.

24. A device according to claim 21, wherein the first portion of the box is arranged to enable the two hinged portions to form a forwardly open angle when the second portion is in the extended position.

25. A device according to claim 1, wherein the second portion of the box is made with a bottom wall presenting on a bottom face a first shape in relief co-operating with a corresponding second shape in relief of the cover to define an end-of-stroke abutment for the second portion when in the extended position.

26. A device according to claim 1, wherein the second portion of the box includes a projection on a top front edge thereof.

27. A device for packaging and dispensing stacked items, the device comprising:

a box comprising:

a first portion;

a second portion that is movable relative to the first portion between a retracted position and an extended position, and including at least one slideway; and a stack of said items disposed in the second portion of the box;

the first portion of the box including a drive member configured firstly to press against the stack of items while the second portion of the box is being moved towards the retracted position, and secondly to entrain an item in contact therewith relative to a remainder of the stack in order to enable the item be grasped by a user;

the second portion of the box and the drive member being configured in such a manner as to no longer put the drive member in contact with the stack of items when the second portion is fully in the retracted position, wherein the second portion of the box includes a slot through which the drive member extends while in contact with the stack, and said at lease one slideway being configured to keep the drive member away from the stack of items during at least a fraction of the stroke of the second portion of the box going from the retracted position toward the extended position.

28. A device for packaging and dispensing stacked items, the device comprising:

a box comprising:

a first portion;

a second portion that is movable relative to the first portion of the box between a retracted position and an extended position, and including at least one slideway; and a stack of said items placed in the second portion of the box;

the first portion of the box including a drive member configured firstly to press against the stack of items while the second portion of the box is being moved toward the retracted position, and secondly to entrain an item in contact therewith relative to a remainder of the stack in order to enable the item be grasped by a user;

the second portion comprising two hinged portions connected together by a hinge, wherein the second portion of the box includes a slot through which the drive member extends while in contact with the stack, and said at least one slideway being configured to keep the drive member away from the stack of items during at least a fraction of the stroke of the second portion of the box going from the retracted position toward the extended position.

29. A method of manufacturing a device for dispensing items, the method comprising the following steps:

placing a stack of items to be dispensed in a drawer comprising two hinged-together portions, and including at least one slideway; and assembling the drawer with a cover;

the cover including a drive member configured to press against the stack of items while the drawer is being moved toward a retracted position, and to entrain an item in contact therewith relative to a remainder of the stack in order to enable the item to be grasped by a user;

the drawer and the drive member also being configured in such a manner as to prevent the drive member from pressing against the stack of items over at least a fraction of the stroke of the drawer from the retracted position towards the extended position, wherein the second portion of the box includes a slot through which the drive member extends while in contact with the stack, and said at least one slideway being configured to keep the drive member away from the stack of items during at least a fraction of the stroke of the drawer going from the retracted position toward the extended position.

30. A method of dispensing items contained in a drawer including at least one slideway that is movable relative to a cover, the items forming a stack in the drawer, a body of the cover including a drive member configured to press against the stack of items while the drawer is being moved toward a retracted position, and to entrain an item in contact therewith relative to a remainder of the stack in order to enable the item to be grasped by a user, the drawer and the drive member also being configured in such a manner as to prevent the drive member from pressing against the stack of items over at least a fraction of the stroke of the drawer from the retracted position toward an extended position.

31. The device of claim 1, wherein the first portion comprises a cover and the second portion comprises a drawer.

32. The device of claim 22, wherein the hinge comprises a film hinge.

33. The device of claim 27, wherein the first portion of the box comprises a cover and the second portion comprises a drawer.

34. The device of claim 28, wherein the first portion of the box comprises a cover and the second portion comprises a drawer.

* * * * *